US012389978B1

(12) United States Patent
Owen

(10) Patent No.: US 12,389,978 B1
(45) Date of Patent: Aug. 19, 2025

(54) ADJUSTABLE FOOTWEAR

(71) Applicant: Radical Sportech LLC, Taipei (TW)

(72) Inventor: Neil Owen, Dongguan (CN)

(73) Assignee: RADICAL SPORTECH LLC, Taipei (TW)

( * ) Notice: Subject to any disclaimer, the term of this patent is extended or adjusted under 35 U.S.C. 154(b) by 0 days.

(21) Appl. No.: 18/797,028

(22) Filed: Aug. 7, 2024

(51) Int. Cl.
*A43B 3/26* (2006.01)

(52) U.S. Cl.
CPC ..... *A43B 3/26* (2013.01)

(58) Field of Classification Search
CPC ..... A43B 3/26
USPC ..... 36/97
See application file for complete search history.

(56) References Cited

U.S. PATENT DOCUMENTS

| | | | | |
|---|---|---|---|---|
| 1,633,413 A * | 6/1927 | La Marca | A43B 7/1466 36/43 |
| 2,700,832 A * | 2/1955 | Slovinski | A43B 7/1464 36/97 |
| 6,938,361 B2 * | 9/2005 | Su | A43B 11/00 36/97 |
| 7,314,222 B2 * | 1/2008 | Borel | A43B 5/005 280/11.26 |
| 2005/0055848 A1 * | 3/2005 | Miller | A43B 1/0072 36/97 |

FOREIGN PATENT DOCUMENTS

KR 20220119894 A * 8/2022

OTHER PUBLICATIONS 8 pages of English Translation of KR 20220119894 (Man) (Year: 2022).*

* cited by examiner

*Primary Examiner* — Ted Kavanaugh
(74) *Attorney, Agent, or Firm* — Muncy, Geissler, Olds & Lowe, P.C.

(57) ABSTRACT

An adjustable footwear is provided, wherein the adjustable footwear includes: a sole including a guide slot and defining a longitudinal direction; a shoe body connected to the sole; a heel adjuster disposed in the shoe body and including a receiving body configured to accommodate a heel of a foot and at least one guide leg extending from the receiving body, the at least one guide leg being inserted in the guide slot, the receiving body being located above the sole; and an adjustment assembly rotatably connected to the sole and including a threaded section screwed with the at least one guide leg, rotation of the adjustment assembly driving the at least one guide leg to move within the guide slot in the longitudinal direction to change the relative position of the receiving body with respect to the heel portion in the longitudinal direction.

7 Claims, 8 Drawing Sheets

ADJUSTABLE FOOTWEAR

BACKGROUND OF THE INVENTION

Field of the Invention

The present invention relates to a footwear, particularly to an adjustable footwear.

Description of the Prior Art

Footwears, such as shoes or boots, can provide various functional needs in different fields of use and offer good protection for feet. Generally, conventional footwears have fixed sizes and thus are suitable for only one foot size, so it is unable to meet the wearing needs of different foot sizes.

There are some adjustable footwears, such as roller skates, which are adjustable and suitable for users with different foot sizes, and it is more economical. However, the conventional adjustable footwears have a sole divided into two parts which are movable relative to each other, resulting in poor structural strength and stability, and the overall appearance is less aesthetic.

The present invention is, therefore, arisen to obviate or at least mitigate the above-mentioned disadvantages.

SUMMARY OF THE INVENTION

The main object of the present invention is to provide an adjustable footwear which is adjustable in size, has an integral sole and appearance without being divided into parts, and offers good wrapping, comfort and protection.

To achieve the above and other objects, an adjustable footwear is provided, wherein the adjustable footwear includes: a sole including a guide slot and defining a longitudinal direction; a shoe body connected to the sole; a heel adjuster disposed in the shoe body and including a receiving body configured to accommodate a heel of a foot and at least one guide leg extending from the receiving body, the at least one guide leg being inserted in the guide slot, the receiving body being located above the sole; and an adjustment assembly rotatably connected to the sole and including a threaded section screwed with the at least one guide leg, rotation of the adjustment assembly driving the at least one guide leg to move within the guide slot in the longitudinal direction to change the relative position of the receiving body with respect to a heel portion of the shoe body in the longitudinal direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
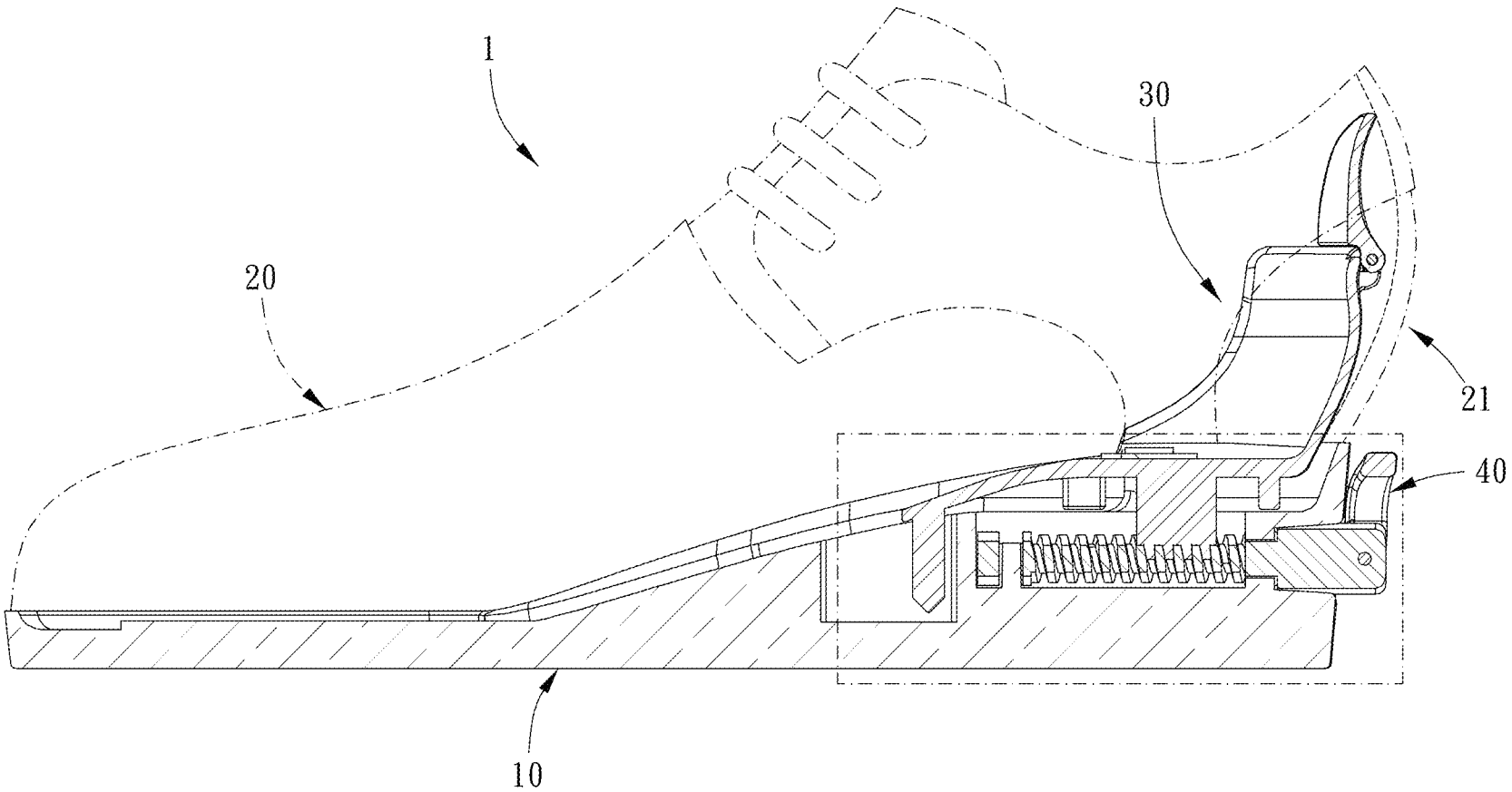
FIG. 1 and FIG. 2 are partial cross-sectional side views of an exemplary embodiment of the present invention.

Please refer to FIGS. 1 to 8 for an exemplary embodiment of the present invention. An adjustable footwear 1 of the present invention includes a sole 10, a shoe body 20, a heel adjuster 30, and an adjustment assembly 40.

Figure 2:
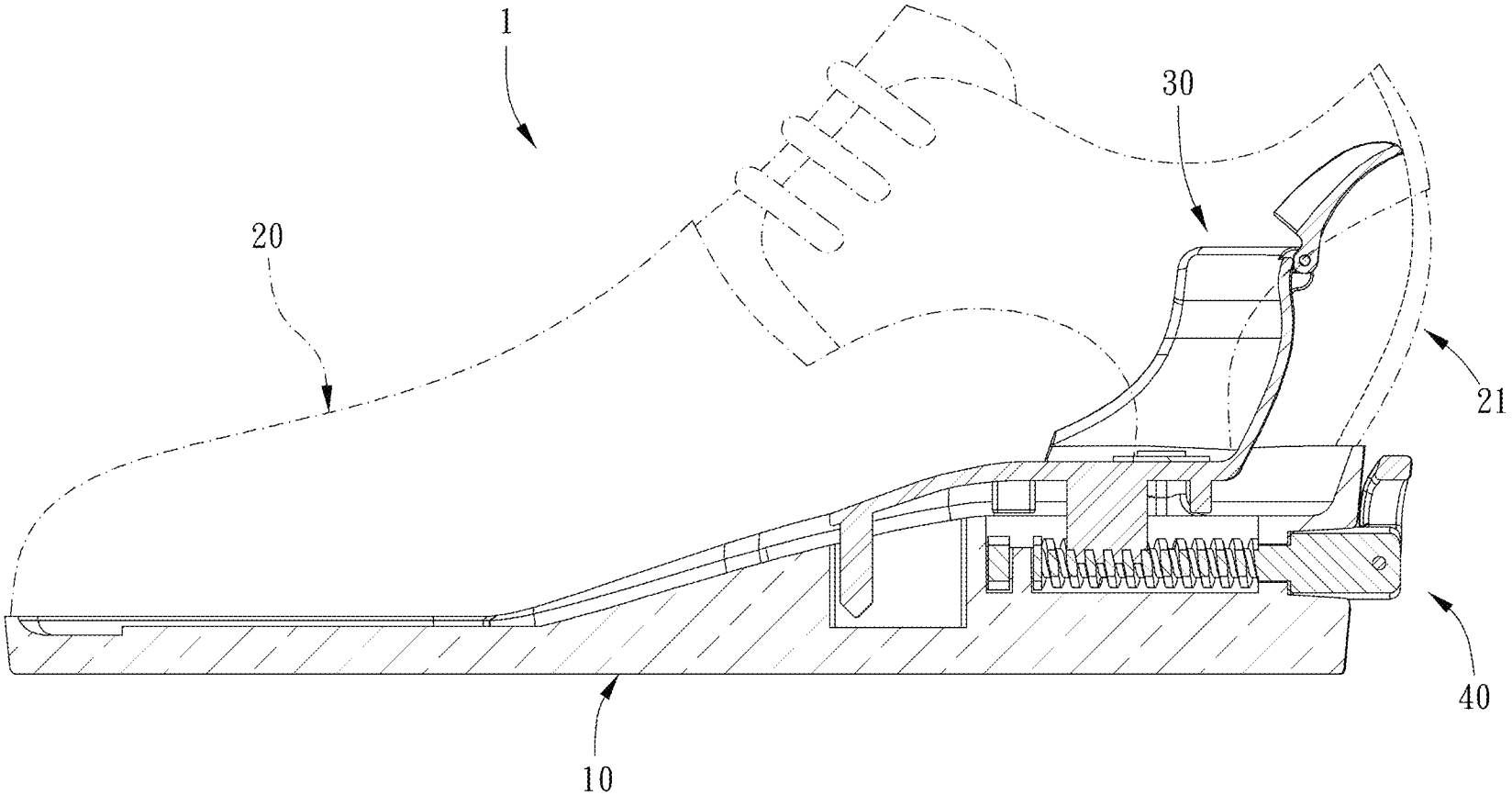
Figure 3:
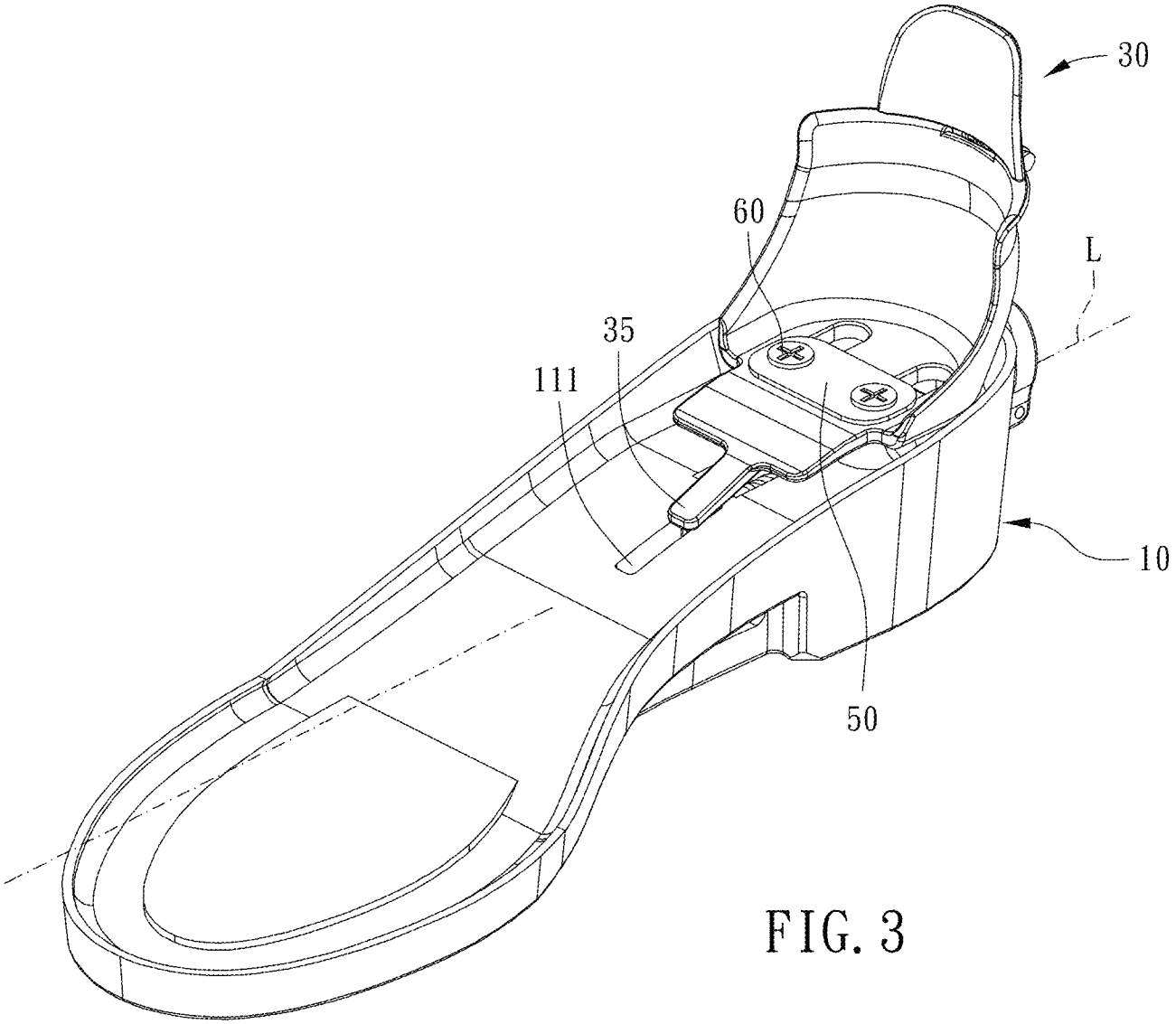
FIG. 3 is a partial perspective view of an exemplary embodiment of the present invention.
Figure 4:
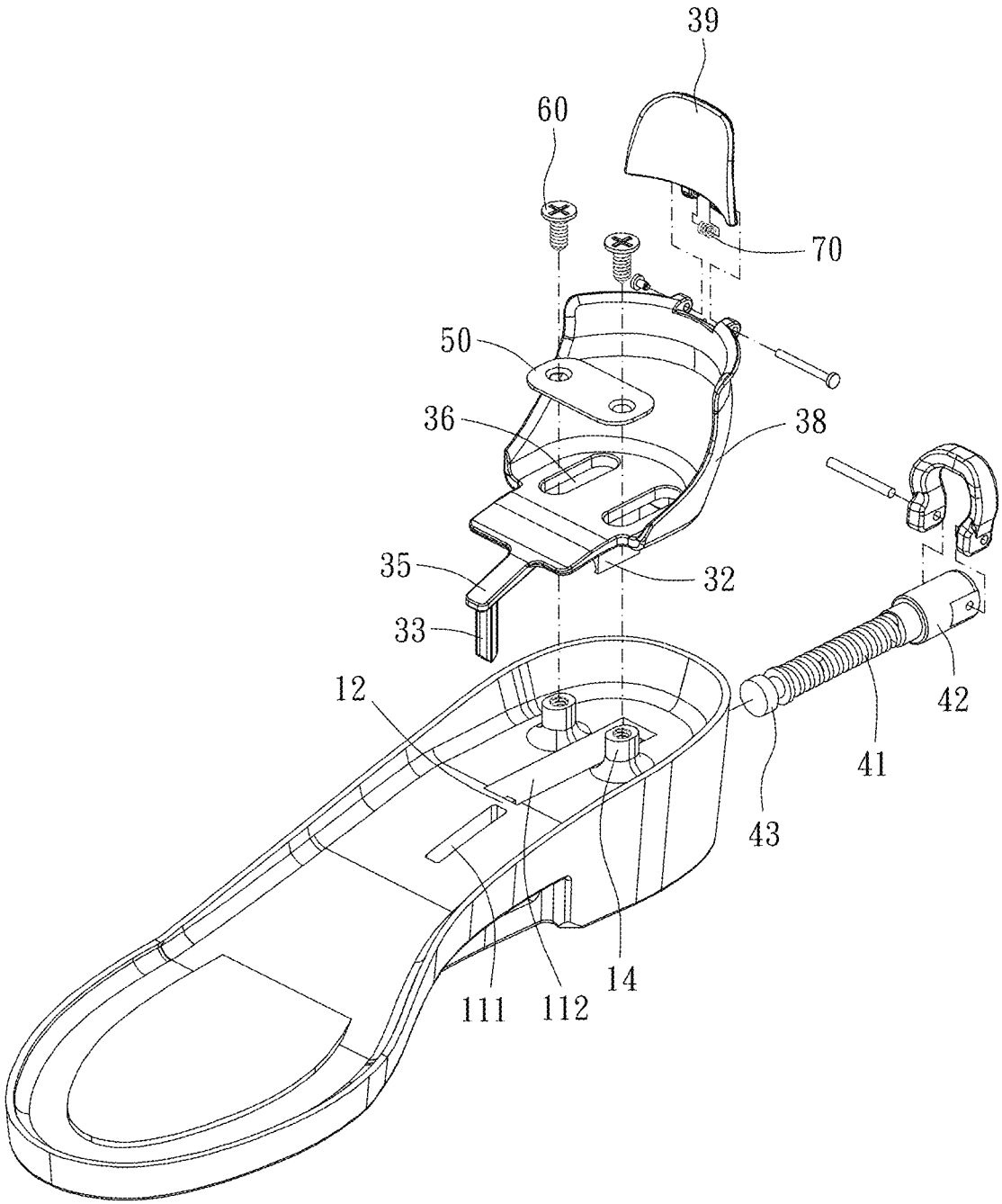
FIG. 4 is a partial exploded view of an exemplary embodiment of the present invention.
Figure 5:
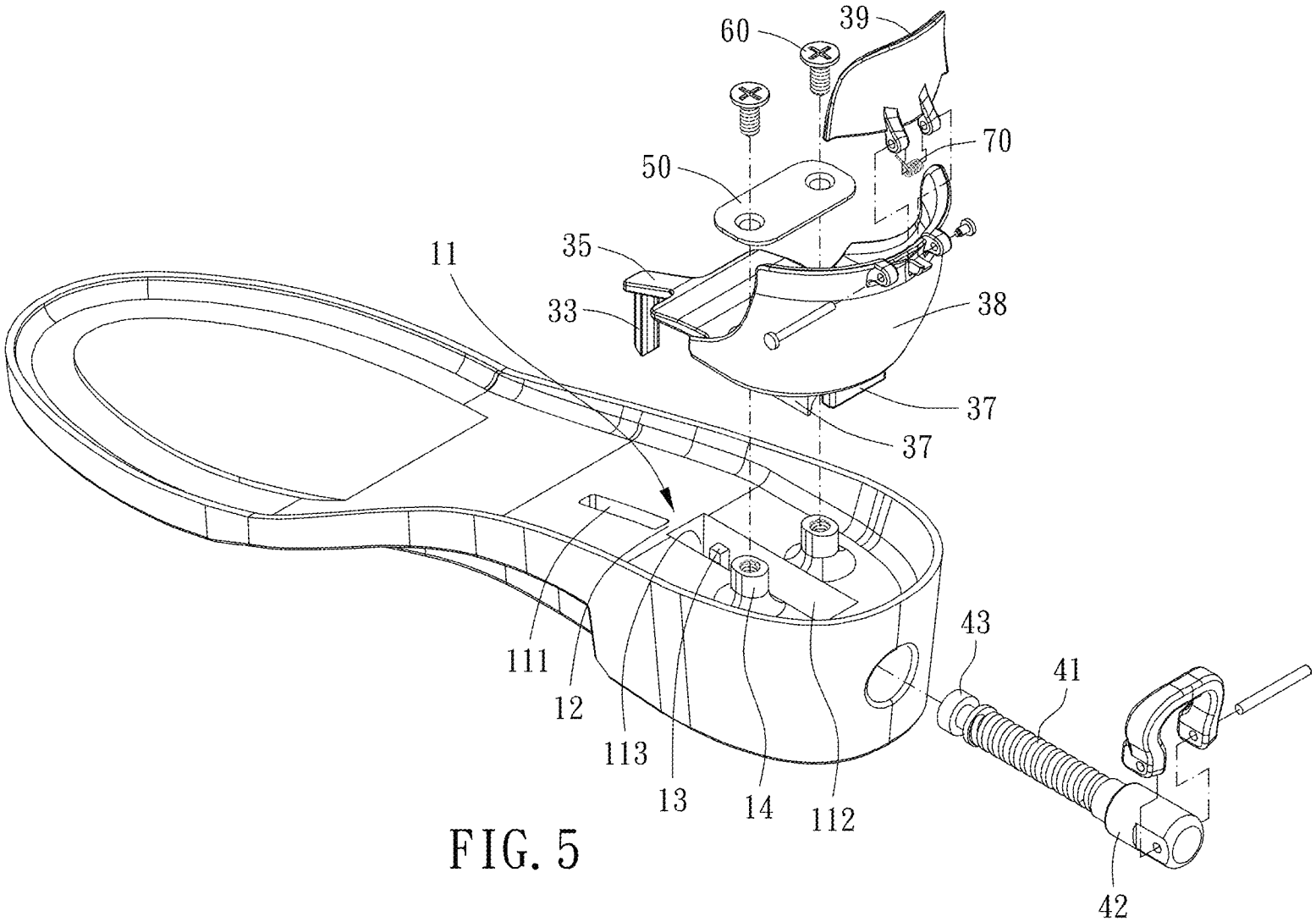
FIG. 5 is another partial exploded view of an exemplary embodiment of the present invention.
Figure 6:
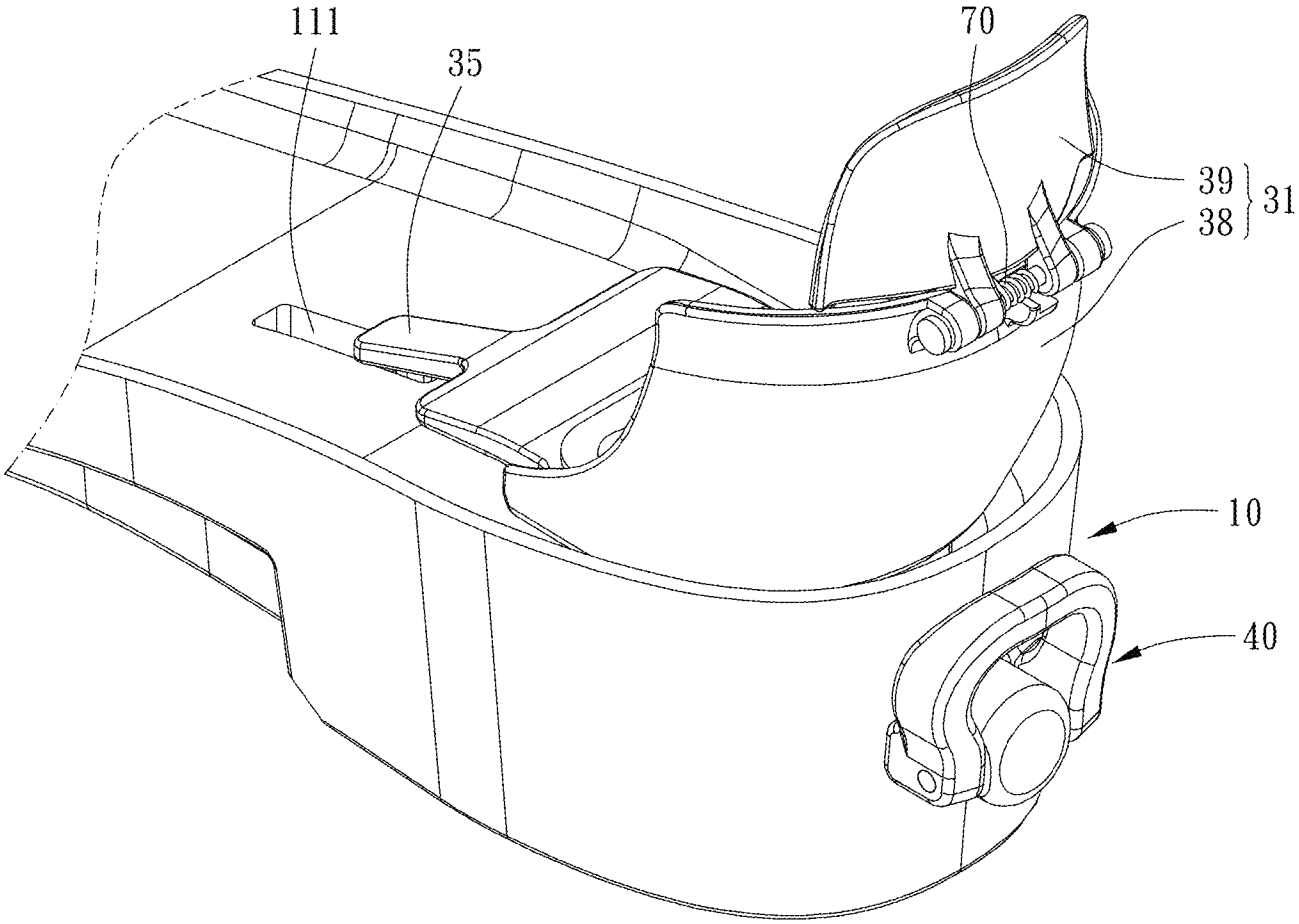
FIG. 6 is another partial perspective view of an exemplary embodiment of the present invention.
Figure 7:
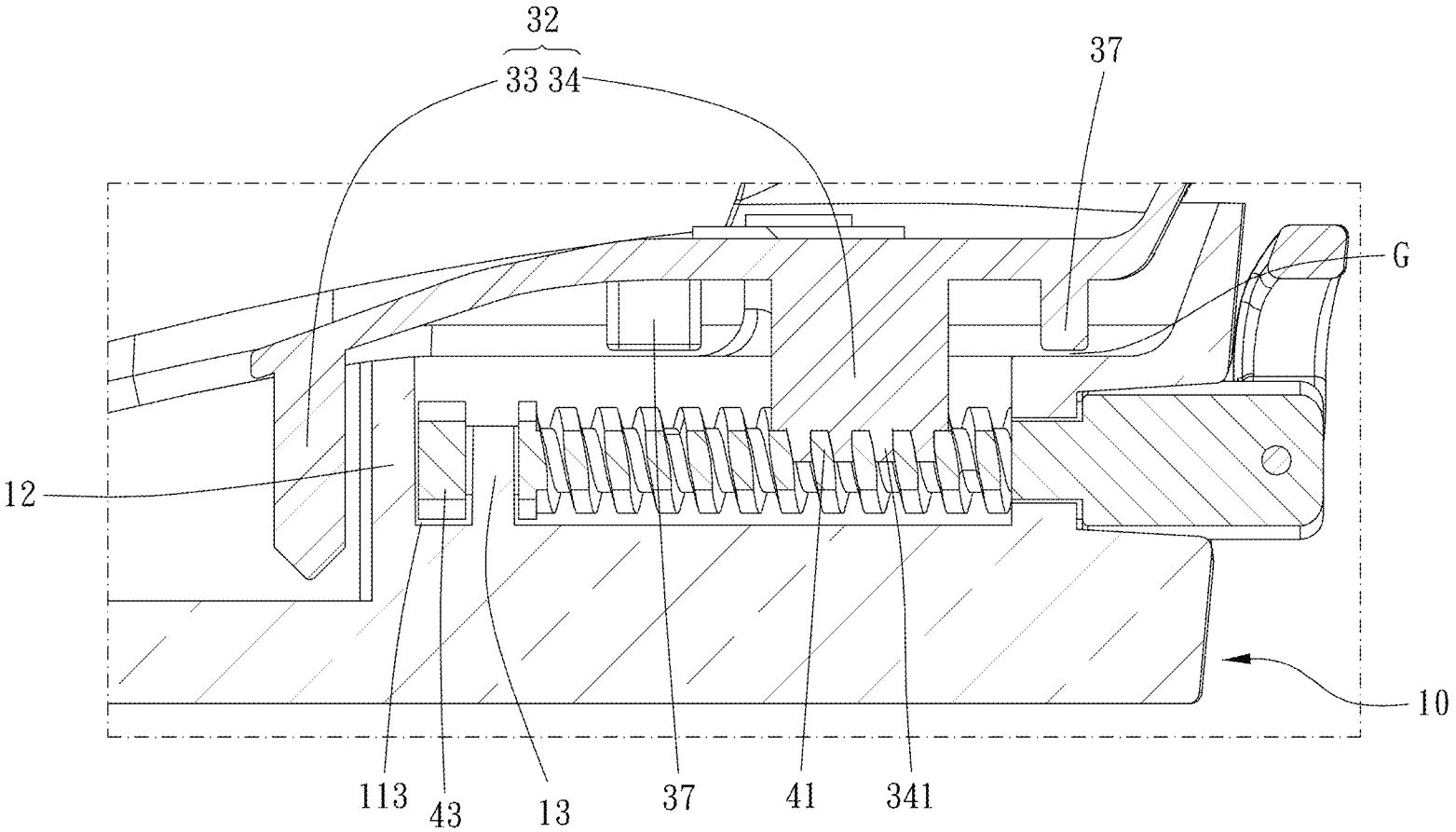
FIG. 7 and FIG. 8 are partial cross-sectional views of an exemplary embodiment of the present invention.
Figure 8:
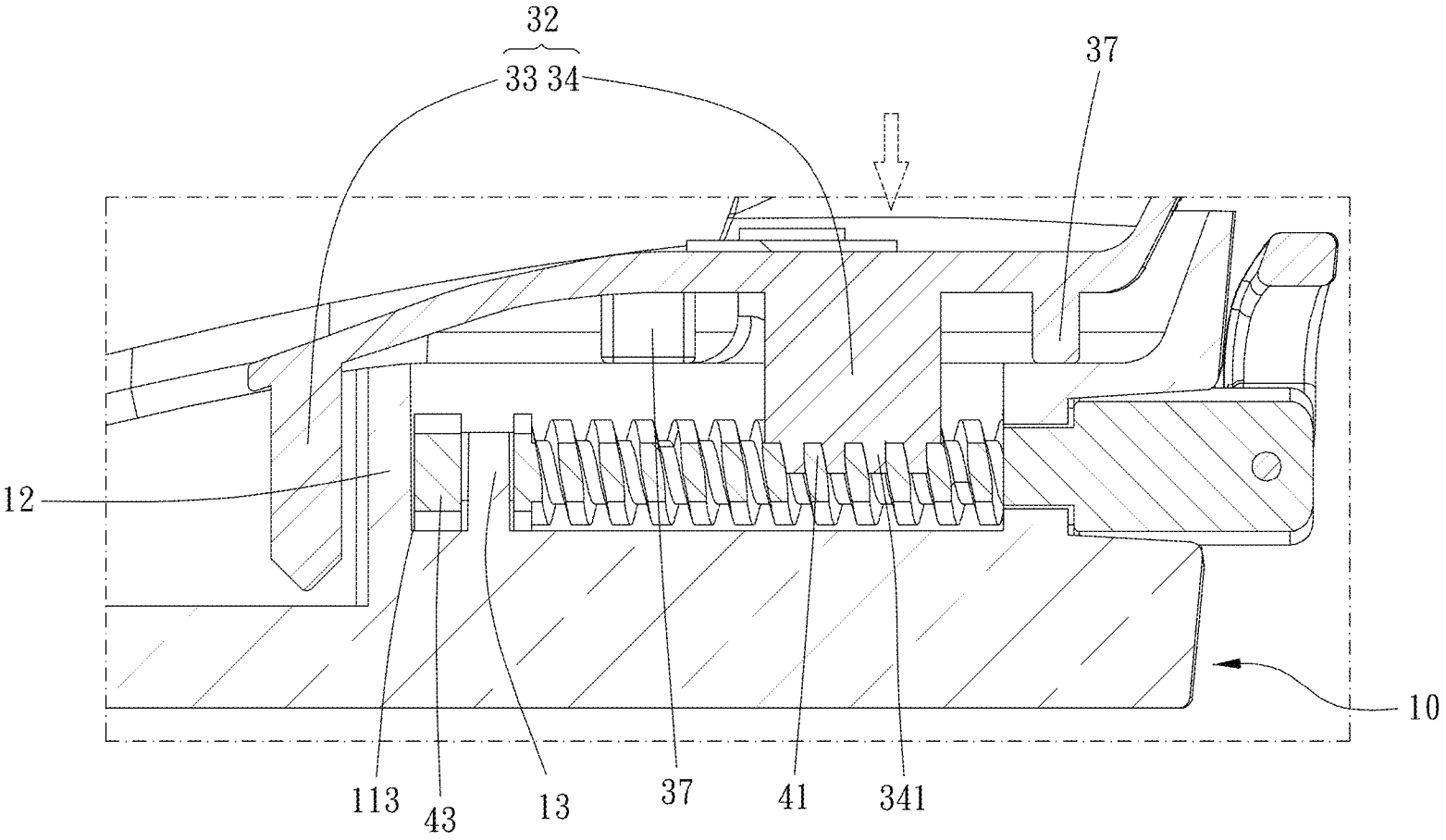

The sole 10 includes a guide slot 11 and defines a longitudinal direction L. The shoe body 20 is connected to the sole 10. The heel adjuster 30 is disposed in the shoe body 20 and includes a receiving body 31 configured to accommodate a heel of a foot and at least one guide leg 32 extending from the receiving body 31. The at least one guide leg 32 is inserted in the guide slot 11, and the receiving body 31 is located above the sole 10. The adjustment assembly 40 is rotatably connected to the sole 10 and includes a threaded section 41 screwed with the at least one guide leg 32. Rotation of the adjustment assembly 40 drives the at least one guide leg 32 to move within the guide slot 11 in the longitudinal direction L to change the relative position of the receiving body 31 with respect to the heel portion 21 of the shoe body 20 in the longitudinal direction L (FIG. 2). As such, the adjustable shoe 1 is adjustable in size, has an integral sole 10 and appearance without being divided into parts, and offers good wrapping, comfort and protection.

The adjustable shoe 1 may be any type of footwear with a heel. For example, as the sole 10 is additionally mounted with a wheel frame having a plurality of rollers, the adjustable shoe is a roller skate; as the sole 10 includes only a midsole and an outsole, the adjustable shoe is a sports shoe, casual shoe, boot, or other types of footwear. The sole 10 may be integrally formed of one piece or a laminated structure. The shoe body 20 may be a flexible component (e.g., an inner liner). In the field of sports goods, the shoe body 20 is a flexible component with an additional outer hard shell connected to the sole 10 for better structural strength and protection.

The sole 10 further includes a first wall 12 and a second wall 13 disposed in interval in the longitudinal direction L. The first wall 12 and the second wall 13 divide the guide slot 11 into a first slot 111, a second slot 112, and a third slot 113 between the first slot 111 and the second slot 112. The heel adjuster 30 includes a first leg 33 inserted in the first slot 111 and a second leg 34 inserted in the second slot 112. A plurality of guide legs can provide stable connection and guiding effects. The adjustment assembly 40 further includes a driving shaft 42 rotatably inserted in the sole 10. The driving shaft 42 includes the threaded section 41 and a radial annular flange 43. The radial annular flange 43 is rotatably received in the third slot 113 and is restricted between the first wall 12 and the second wall 13, facilitating easy assembly and stable positioning. The second leg 34 includes a thread 341 screwed with the threaded section 41 of the adjustment assembly 40. In this embodiment, the second leg 34 includes a threaded half hole for easy assembly and quick engagement with the threaded section 41. Thus, by rotating the driving shaft 42, the second leg 34 can be driven to move the heel adjuster 30, thereby adjusting the size of the adjustable shoe 1.

Specifically, the width of the second slot 112 is greater than the width of the first slot 111, and the width of the second leg 34 is greater than the width of the first leg 33, which provides good structural strength and stable guiding. The receiving body 31 extends forward to form an elongate portion 35. The first leg 33 is disposed on the elongate portion 35, and the elongate portion 35 covers at least a part of the first slot 111, so that it can reduce the excavation range of the first slot 111 and maintain the structural strength of the sole 10.

The sole 10 further includes a plurality of columns 14 located on opposing sides of the guide slot 11. The receiving body 31 further includes a plurality of guide grooves 36. The plurality of columns 14 are inserted in the plurality of guide grooves 36, respectively. The adjustable shoe 1 further includes a limiting plate 50 and a plurality of fasteners 60. The plurality of fasteners 60 are disposed through the limiting plate 50 and fixed to the plurality of columns 14, respectively. The receiving body 31 is movably disposed between the limiting plate 50 and the sole 10, thus stabilizing and strengthening the structure of the heel adjuster 30.

Preferably, at least one supporting member 37 projects from a bottom surface of the receiving body 31. A gap G is formed between the at least one supporting member 37 and the top surface of the sole 10 (FIG. 7), which reduces friction and facilitates the adjustment of the heel adjuster 30. When the receiving body 31 receives a load and the driving shaft 42 is radially deformed, the at least one supporting member 37 is supported on a top surface of the sole 10 (FIG. 8), preventing damage to the driving shaft 42 and avoiding unexpected movement of the receiving body 31 relative to the driving shaft 42, and thus it can stably maintain the size of the adjustable shoe 1.

In this embodiment, the receiving body 31 includes a shell body 38 and a tongue 39. The shell body 38 includes the at least one guide leg 32, and the tongue 39 is swingably connected to an upper portion of the shell body 38. The tongue 39 is swingable to abut against the inner surface of the shoe body 20. Preferably, the receiving body 31 further includes an elastic member 70. The elastic member 70 is disposed between the shell body 38 and the tongue 39, and the elastic member 70 elastically biases the tongue 39 towards the inner surface of the shoe body 20. Thus, when the heel adjuster 30 moves away from the inner surface of the shoe body 20, the tongue 39 can swing towards the inner surface of the shoe body 20 to eliminate or reduce the gap between the heel adjuster 30 and the inner surface of the shoe body 20, and the tongue 39 can serve as a shoehorn for easy wearing.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adjustable footwear including:

a sole including a guide slot and defining a longitudinal direction;

a shoe body connected to the sole;

a heel adjuster disposed in the shoe body and including a receiving body configured to accommodate a heel of a foot and at least one guide leg extending from the receiving body, the at least one guide leg being inserted in the guide slot, the receiving body being located above the sole; and an adjustment assembly rotatably connected to the sole and including a threaded section screwed with the at least one guide leg, rotation of the adjustment assembly driving the at least one guide leg to move within the guide slot in the longitudinal direction to change the relative position of the receiving body with respect to a heel portion of the shoe body in the longitudinal direction;

wherein at least one supporting member projects from a bottom surface of the receiving body, and a gap is formed between the at least one supporting member and a top surface of the sole;

wherein the sole further includes a first wall and a second wall disposed in interval in the longitudinal direction, the first wall and the second wall divide the guide slot into a first slot, a second slot, and a third slot between the first slot and the second slot, the heel adjuster further includes a first leg inserted in the first slot and a second leg inserted in the second slot, the adjustment assembly further includes a driving shaft rotatably inserted in the sole, the driving shaft includes the threaded section and a radial annular flange, the radial annular flange is rotatably received in the third slot and is restricted between the first wall and the second wall, and the second leg includes a thread screwed to the threaded section of the adjustment assembly.

2. The adjustable footwear of claim 1, wherein when the receiving body receives a load and the driving shaft is radially deformed, the at least one supporting member is supported on the top surface of the sole.

3. The adjustable footwear of claim 1, wherein a width of the second slot is greater than a width of the first slot, and a width of the second leg is greater than a width of the first leg.

4. The adjustable footwear of claim 3, wherein the receiving body extends forward to form an elongate portion, the first leg is disposed on the elongate portion, and the elongate portion covers at least a part of the first slot.

5. An adjustable footwear including:

a sole including a guide slot and defining a longitudinal direction;

a shoe body connected to the sole;

a heel adjuster disposed in the shoe body and including a receiving body configured to accommodate a heel of a foot and at least one guide leg extending from the receiving body, the at least one guide leg being inserted in the guide slot, the receiving body being located above the sole; and an adjustment assembly rotatably connected to the sole and including a threaded section screwed with the at least one guide leg, rotation of the adjustment assembly driving the at least one guide leg to move within the guide slot in the longitudinal direction to change the relative position of the receiving body with respect to a heel portion of the shoe body in the longitudinal direction;

wherein the sole further includes a plurality of columns located on opposing sides of the guide slot, the receiving body includes a plurality of guide grooves, and the plurality of columns are inserted in the plurality of guide grooves, respectively.

6. The adjustable footwear of claim 5, further including a limiting plate and a plurality of fasteners, wherein the plurality of fasteners are disposed through the limiting plate and fixed to the plurality of columns, respectively, and the receiving body is movably disposed between the limiting plate and the sole.

7. An adjustable footwear including:

a sole including a guide slot and defining a longitudinal direction;

a shoe body connected to the sole;

a heel adjuster disposed in the shoe body and including a receiving body configured to accommodate a heel of a foot and at least one guide leg extending from the receiving body, the at least one guide leg being inserted in the guide slot, the receiving body being located above the sole; and an adjustment assembly rotatably connected to the sole and including a threaded section screwed with the at least one guide leg, rotation of the adjustment assembly driving the at least one guide leg to move within the guide slot in the longitudinal direction to change the relative position of the receiving body with respect to a heel portion of the shoe body in the longitudinal direction;

wherein the receiving body includes a shell body and a tongue, the shell body includes the at least one guide leg, the tongue is swingably connected to an upper portion of the shell body, and the tongue is swingable to abut against an inner surface of the shoe body;

wherein the receiving body further includes an elastic member, the elastic member is disposed between the shell body and the tongue, and the elastic member elastically biases the tongue towards the inner surface of the shoe body.

* * * * *